US008720749B1

(12) United States Patent
Greco

(10) Patent No.: US 8,720,749 B1
(45) Date of Patent: May 13, 2014

(54) PORTABLE MOUTHWASH CARRYING DEVICE

(76) Inventor: Louis Greco, Henderson, NV (US)

( * ) Notice: Subject to any disclaimer, the term of this patent is extended or adjusted under 35 U.S.C. 154(b) by 0 days.

(21) Appl. No.: 13/484,447

(22) Filed: May 31, 2012

(51) Int. Cl.
*B65D 47/10* (2006.01)

(52) U.S. Cl.
USPC ..... 222/541.9; 222/1; 222/107; 222/541.6

(58) Field of Classification Search
USPC ..... 222/107, 215, 541.6, 541.9, 1
See application file for complete search history.

(56) References Cited

U.S. PATENT DOCUMENTS

| | | | | | |
|---|---|---|---|---|---|
| 3,904,058 | A | | 9/1975 | Rosenstein | |
| 3,917,120 | A | * | 11/1975 | Larenz et al. | 222/129 |
| 3,937,371 | A | * | 2/1976 | Del Bon | 222/494 |
| 3,993,223 | A | * | 11/1976 | Welker et al. | 222/107 |
| 4,248,227 | A | * | 2/1981 | Thomas | 604/200 |
| 4,358,028 | A | * | 11/1982 | Chiquiar-Arias | 222/107 |
| 4,378,069 | A | * | 3/1983 | Franco | 383/207 |
| 4,717,046 | A | * | 1/1988 | Brogli | 222/107 |
| 4,787,536 | A | * | 11/1988 | Widerstrom | 222/212 |
| 4,792,060 | A | * | 12/1988 | Brogli | 222/107 |
| 4,871,091 | A | | 10/1989 | Preziosi | |
| 5,002,189 | A | | 3/1991 | Sahi | |
| 5,121,856 | A | * | 6/1992 | Weiler et al. | 222/209 |
| 5,577,636 | A | * | 11/1996 | Fukuoka et al. | 222/94 |
| 5,826,737 | A | * | 10/1998 | Zakensberg | 215/47 |
| 6,258,057 | B1 | | 7/2001 | Marinello et al. | |
| 6,260,735 | B1 | * | 7/2001 | Fuquen | 222/94 |
| 6,447,754 | B1 | | 9/2002 | Kligerman et al. | |
| 7,028,862 | B2 | * | 4/2006 | Poynter | 222/23 |
| 7,073,692 | B2 | * | 7/2006 | Weyts | 222/541.9 |
| D526,573 | S | | 8/2006 | Ueda | |
| 7,562,796 | B2 | * | 7/2009 | Zahn et al. | 222/541.9 |
| 2005/0271306 | A1 | | 12/2005 | Murray | |
| 2006/0015062 | A1 | | 1/2006 | Kahen | |
| 2007/0227073 | A1 | * | 10/2007 | Tognetti et al. | 49/377 |
| 2009/0071979 | A1 | * | 3/2009 | Sharp et al. | 222/107 |

* cited by examiner

*Primary Examiner* — Frederick C Nicolas

(57) ABSTRACT

A portable mouthwash carrying device is provided for transporting and using a single use portion of mouthwash. The device includes a pouch having a closed bottom. A perimeter wall extends upwardly from the closed bottom. The closed bottom and the perimeter wall define an interior space of the pouch. A tab is coupled to and extends from the pouch. The interior space extends into a bottom of the tab. The tab is removable from the pouch to form an opening into the interior space. A fluid, more particularly mouthwash, is contained in the interior space.

7 Claims, 4 Drawing Sheets

PORTABLE MOUTHWASH CARRYING DEVICE

BACKGROUND OF THE DISCLOSURE

Field of the Disclosure

The disclosure relates to fluid carrying devices and more particularly pertains to a new fluid carrying device for transporting a single use portion of mouthwash.

SUMMARY OF THE DISCLOSURE

An embodiment of the disclosure meets the needs presented above by generally comprising a pouch having a closed bottom. A perimeter wall extends upwardly from the closed bottom. The closed bottom and the perimeter wall define an interior space of the pouch. A tab is coupled to and extends from the pouch. The interior space extends into a bottom of the tab. The tab is removable from the pouch to form an opening into the interior space. A fluid, more particularly mouthwash, is contained in the interior space.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
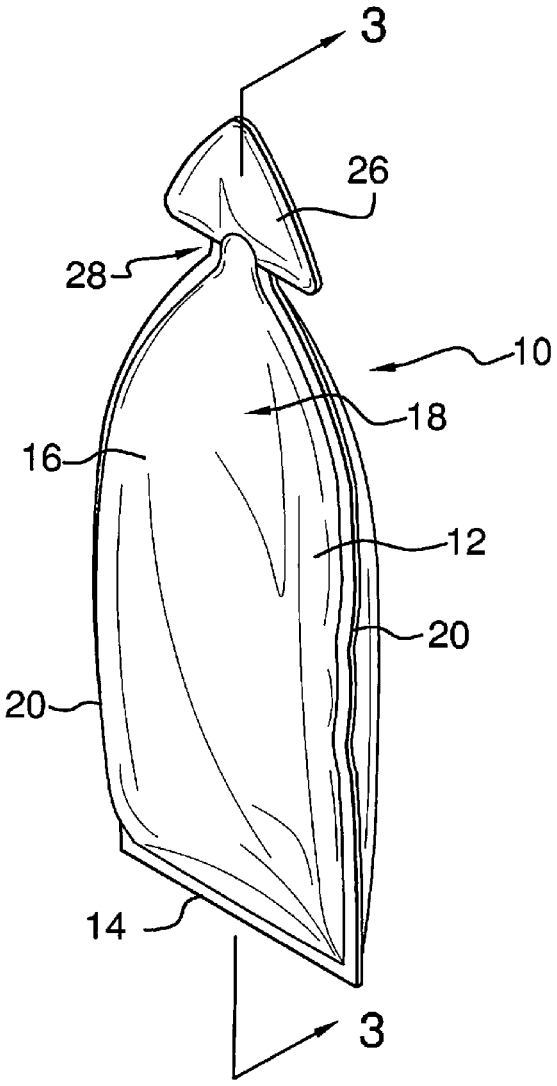
FIG. 1 is a top front side perspective view of a portable mouthwash carrying device according to an embodiment of the disclosure.
Figure 2:
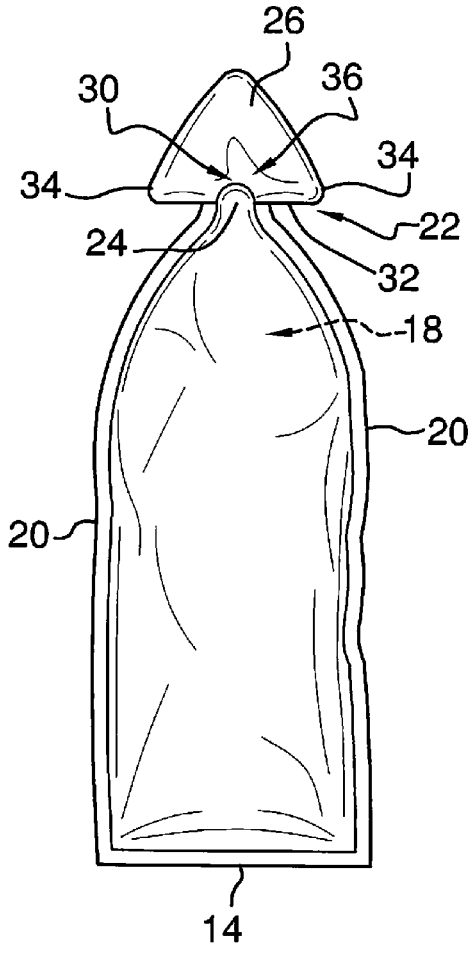
FIG. 2 is a front view of an embodiment of the disclosure.
Figure 3:
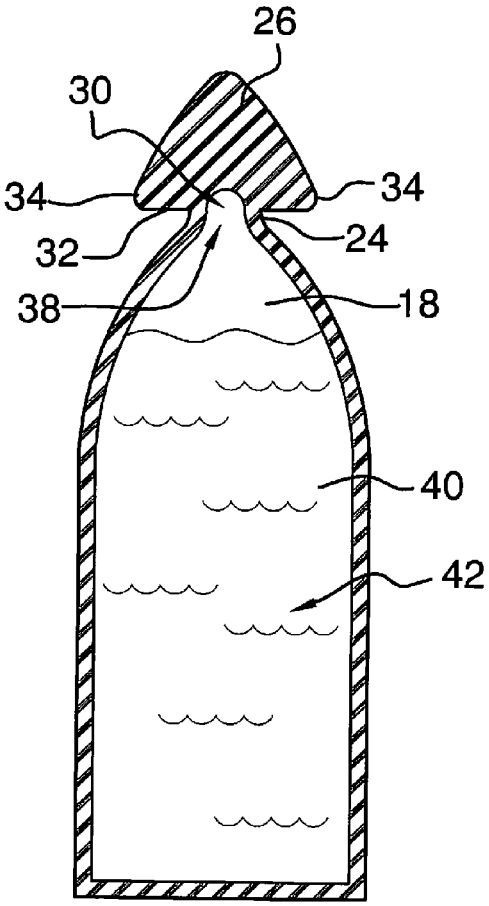
FIG. 3 is a cross-sectional view of an embodiment of the disclosure taken along line 3-3 of FIG. 1.
Figure 4:
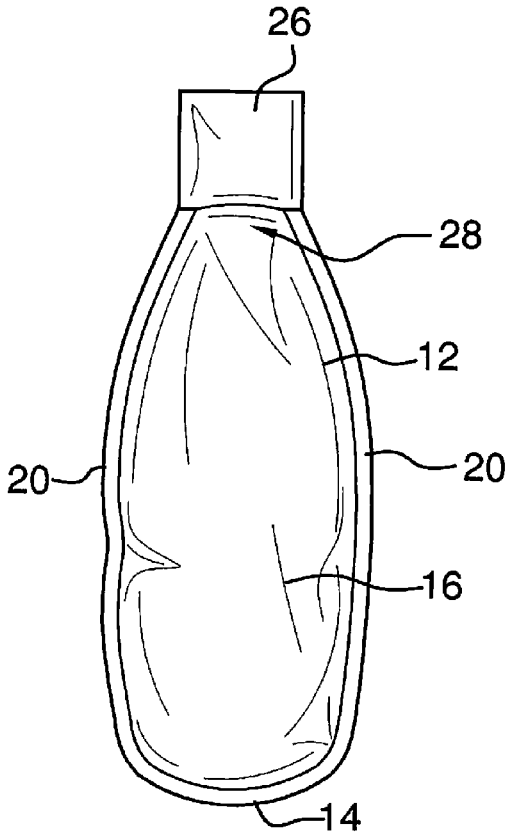
FIG. 4 is a front view of an embodiment of the disclosure.
Figure 5:
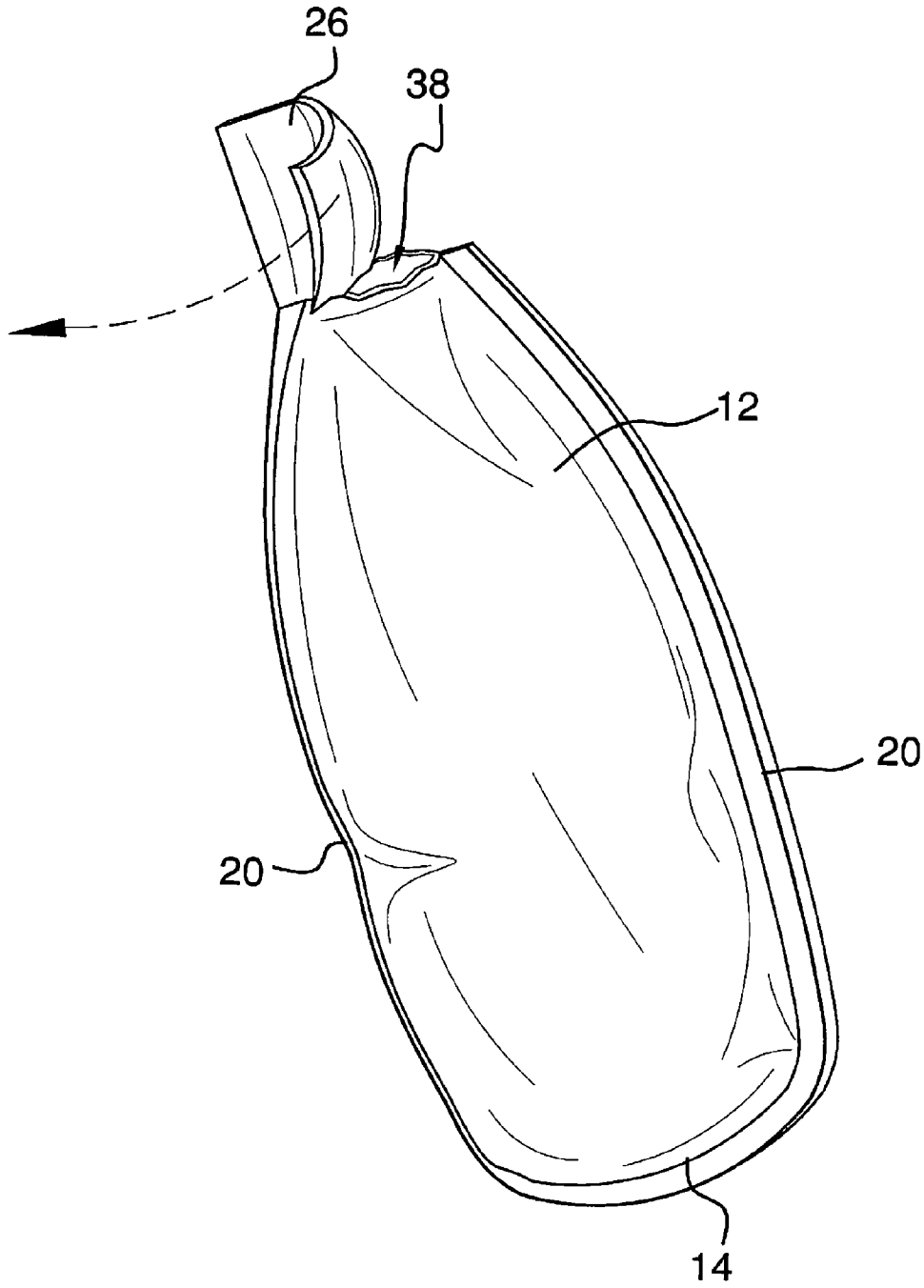
FIG. 5 is a top front side perspective view of an embodiment of the disclosure.
Figure 6:
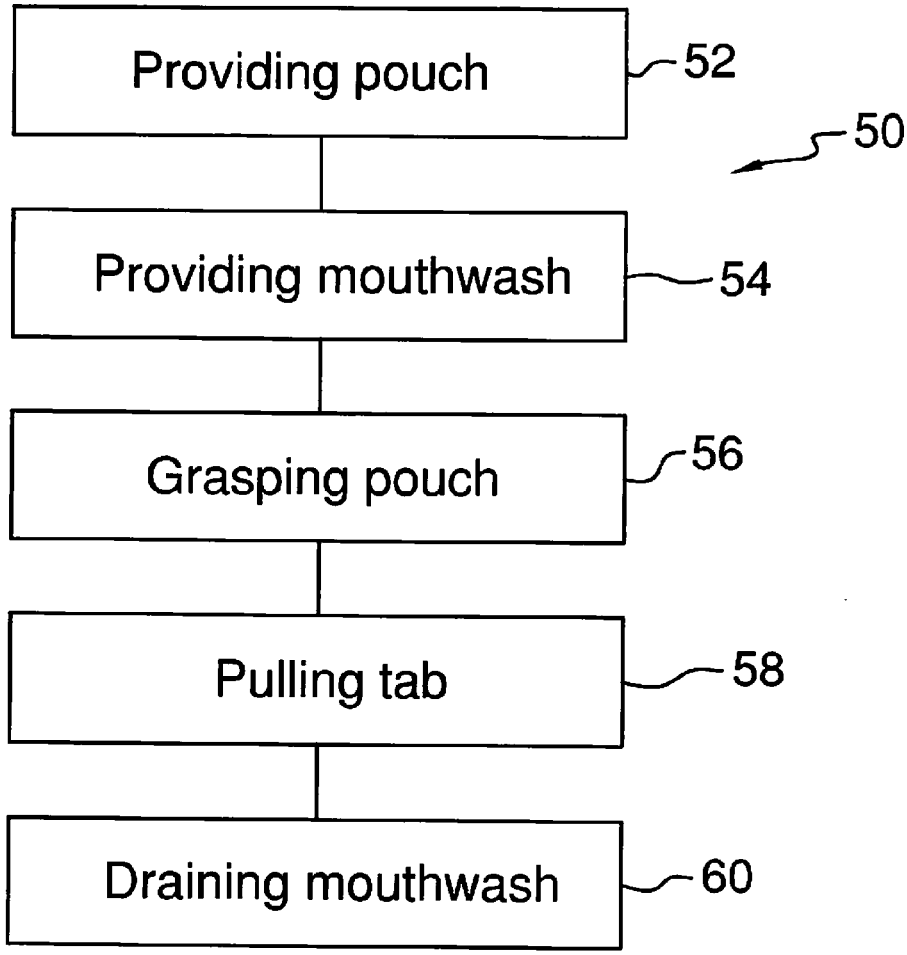
FIG. 6 is a schematic view of a method according to an embodiment of the disclosure.

With reference now to the drawings, and in particular to FIGS. 1 through 6 thereof, a new fluid carrying device embodying the principles and concepts of an embodiment of the disclosure and generally designated by the reference numeral 10 will be described.

As best illustrated in FIGS. 1 through 6, the portable mouthwash carrying device 10 generally comprises a pouch 12 having a closed bottom 14. A perimeter wall 16 extends upwardly from the closed bottom 14. The closed bottom 14 and the perimeter wall 16 define an interior space 18 of the pouch 12. The perimeter wall 16 has opposed sides 20. The opposed sides 20 extend inwardly approaching a top 22 of the pouch 12 forming a neck 24. The interior space 18 extends through the neck 24. The neck 24 is frangible to facilitate gaining access to the interior space 18.

A stiff triangular tab 26 is integrally coupled to and extends from the pouch 12. The tab 26 is joined to the pouch 12 at a junction 28. The junction 28 may be positioned at a center 30 of a bottom side 32 of the triangular tab 26 providing opposed corners 34 to facilitate grasping and manipulating the tab 26. The tab 26 may alternatively have a non-triangular shape. The interior space 18 extends into a bottom 36 of the tab 26. The neck 24 is positioned adjacent to the bottom 36 of the tab 26. The tab 26 is removable from the pouch 12 to form an opening 38 into the interior space 18. A fluid 40 is contained in the interior space 18. The fluid 40 may be a single serving of mouthwash 42 of a volume between 10 and 20 milliliters. The perimeter wall 16 is compressible to urge the mouthwash 42 out of the pouch 12 as desired if necessary.

In use, the device 10 provides for a method 50 of holding and using the single serving of mouthwash 42. An initial step 52 is providing the pouch 12 having the closed bottom 14 and the perimeter wall 16 as more particularly described above. Another step 54 is providing a quantity of mouthwash 42 sealed in the interior space 18. The mouthwash 42 may thus be carried or otherwise held until ready for use to freshen breath. Accessing the mouthwash 42 begins with a step 56 of grasping the pouch 12 and the tab 26. A next step 58 is pulling the tab 26 across the pouch 12 whereby the pouch 12 is torn across the neck 24 to create the opening 38 into the interior space 18. A final step 60 is draining the mouthwash 42 from the interior space 18 directly into a mouth of a user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A mouthwash carrying device comprising:

a pouch having a closed bottom, a perimeter wall extending upwardly from said closed bottom, said closed bottom and said perimeter wall defining an interior space of said pouch, said perimeter wall having opposed sides, said opposed sides extending inwardly approaching a top of said pouch forming a neck, said interior space extending through said neck;

a tab coupled to and extending from said pouch, said interior space extending into a bottom of said tab, said tab being removable from said pouch such that pulling said tab across said pouch tears said neck to form an opening into said interior space, said tab being triangular having rounded corners wherein said tab is inhibited from inadvertent snagging and removal of said tab from said pouch; and a fluid contained in said interior space.

2. The device of claim 1, further including said neck being positioned adjacent to a bottom of said tab.

3. The device of claim 1, further including said tab being stiff.

4. The device of claim 1, further including said tab being integrally coupled to said pouch.

5. The device of claim 1, further including said neck being frangible.

6. A mouthwash carrying device comprising:

a pouch having a closed bottom, a perimeter wall extending upwardly from said closed bottom, said closed bottom and said perimeter wall defining an interior space of said pouch, said perimeter wall having opposed sides, said opposed sides extending inwardly approaching a top of said pouch forming a neck, said interior space extending through said neck, said neck being frangible;

a stiff triangular tab integrally coupled to and extending from said pouch, said tab having rounded corners wherein said tab is inhibited from inadvertent snagging and removal of said tab from said pouch, said interior space extending into a bottom of said tab, said neck being positioned adjacent to said bottom of said tab, said tab being removable from said pouch such that pulling said tab across said pouch tears said neck to form an opening into said interior space; and a fluid contained in said interior space, said fluid being between 10 milliliters and 20 milliliters of mouthwash.

7. A method of holding and using a single serving of mouthwash, the steps of the method comprising:

providing a pouch having a closed bottom and a perimeter wall extending upwardly from said closed bottom defining an interior space of said pouch, a tab being coupled to said pouch, said tab being triangular having rounded corners wherein said tab is inhibited from inadvertent snagging and removal of said tab from said pouch, said interior space extending through a neck of said pouch and into said tab;

providing a quantity of mouthwash sealed in said interior space;

grasping said pouch and said tab;

pulling said tab across said pouch whereby said pouch is torn forming an opening into said interior space; and draining said mouthwash from said interior space and into a mouth of a user.

* * * * *